US007063109B2

(12) United States Patent
Siegl et al.

(10) Patent No.: US 7,063,109 B2
(45) Date of Patent: Jun. 20, 2006

(54) SYSTEM AND METHOD FOR INSERTING A WEFT THREAD

(75) Inventors: Walter Siegl, Staefa (CH); Klaus Berktold, Rueti (CH)

(73) Assignee: Sultex AG, Rueti (CH)

( * ) Notice: Subject to any disclaimer, the term of this patent is extended or adjusted under 35 U.S.C. 154(b) by 0 days.

(21) Appl. No.: 10/811,201

(22) Filed: Mar. 25, 2004

(65) Prior Publication Data

US 2004/0216800 A1 Nov. 4, 2004

(30) Foreign Application Priority Data

Apr. 29, 2003 (EP) ..... 03405299

(51) Int. Cl.
*D03D 47/30* (2006.01)

(52) U.S. Cl. ..... 139/435.2

(58) Field of Classification Search ..... 139/435.2, 139/435.1, 435.3, 435.4, 435.5, 435.6
See application file for complete search history.

(56) References Cited

U.S. PATENT DOCUMENTS 4,446,893 A 5/1984 Gunneman et al.
4,595,039 A * 6/1986 Tholander ..... 139/435.2
4,830,063 A * 5/1989 Takegawa ..... 139/435.2

FOREIGN PATENT DOCUMENTS

| | | |
|---|---|---|
| EP | 0493328 A1 | 7/1992 |
| EP | 0554222 A1 | 8/1993 |
| JP | 03064552 | 3/1991 |
| JP | 06093534 | 4/1994 |
| WO | WO 92/04490 A1 | 3/1992 |

* cited by examiner

*Primary Examiner*—John J. Calvert
*Assistant Examiner*—Brian Kauffman
(74) *Attorney, Agent, or Firm*—Townsend and Townsend and Crew LLP

(57) ABSTRACT

A system for inserting a weft thread into a shed of an air jet weaving machine includes a thread store with a measuring apparatus, a plurality of air nozzles for the insertion of the weft thread and a control system which is connected to the measuring apparatus in order to be able to control the compressed air supply of the air nozzles in dependence on measurement values of the measuring apparatus. Switch-on points are associated with the air nozzles, with the control system charging one or more of the air nozzles with compressed air as soon as a predictor value for the position of the weft thread tip, which is formed with the help of the measurement values, reaches the switch-on point of the relevant air nozzle or air nozzles respectively.

13 Claims, 4 Drawing Sheets

SYSTEM AND METHOD FOR INSERTING A WEFT THREAD

BACKGROUND OF THE INVENTION

The invention relates to a system and a method for inserting a weft thread into a shed of an air jet weaving machine.

In an air jet weaving machine, the weft thread which is drawn off from a thread store is accelerated by main and tandem nozzles and inserted into a shed, in which it is further transported by so-called auxiliary or relay nozzles. In conventional air jet weaving machines the relay nozzles are switched on and off by a pre-selected profile which is firmly connected to the rotation of the main machine shaft. It is left up to the weaving master to ideally adapt this profile for a definite article, with more attention generally being paid to the cloth quality than to the air consumption.

In the specification EP 0 554 222 A1 a method is described for the regulation of the weft insertion for a jet weaving machine with a plurality of weft thread monitors which are arranged in the shed in order to be able to determine the time point at which the front end of an inserted weft thread arrives at the location of a weft thread monitor. In the described method the measured time point is compared with a predetermined reference arrival time and the blown-in compressed air of the auxiliary nozzles or groups of auxiliary nozzles which are arranged ahead of or after the weft thread monitor is modified as a result of the comparison of desired and actual values; i.e. the auxiliary nozzles are supplied with low, normal or increased pressure. In the event of a premature arrival the blowing or ventilation time of the auxiliary nozzles can also be shortened in order to delay the weft thread.

The method which is described in EP 0 554 222 A1 is relatively complicated and expensive, since it requires three separate compressed air supplies for the auxiliary nozzles. Furthermore, the simultaneous charging of a plurality of groups of auxiliary nozzles admittedly permits a careful acceleration of the weft thread, which is however associated with a drastically increased consumption of compressed air. In addition, the arrangement of a large number of weft thread monitors in the shed is problematical, since the former damage the warp threads and can thereby influence the cloth quality.

SUMMARY OF THE INVENTION

An object of the present invention is to make available a system and a method for inserting a weft thread into a shed of an air jet weaving machine which have a control of the air jets which is simple and ideal with respect to the compressed air consumption, which manage with a comparatively low cost and complexity of system components, and which ensure an unobjectionable cloth quality. A further object of the invention is to make available an air jet weaving machine including a system of this kind and for carrying out a method of this kind.

The system for inserting a weft thread into a shed of an air jet weaving machine includes a thread store, a measuring apparatus in order to be able to measure the weft thread which is drawn off from the thread store, a plurality of air nozzles for the insertion of the weft thread and a control system which is connected to the measuring apparatus in order to be able to control the compressed air supply of the air nozzles in dependence on measurement values of the measuring apparatus. In this system switch-on points are associated with the air nozzles, and the control system is formed in such a manner that one or more of the air nozzles is or are charged with compressed air as soon as a predictor value for the position of the weft thread tip, which is formed with the help of the measurement values, reaches the switch-on point of the relevant air nozzle or air nozzles respectively.

The switch-on point of an air nozzle preferably corresponds to the position of the air nozzle in the shed or, respectively, in the case of a group of air nozzles which are charged with compressed air at the same time, to the position of the first air nozzle of the group to be passed by the weft thread tip.

The predictor value for the position of the weft thread tip preferably contains a safety value or factor which depends in particular on the resolution of the measuring apparatus and/or on the switch-on time for the pressure build-up in the region of the relevant air nozzle and/or on the speed of the weft thread tip.

The predictor values for the position of the weft thread tip and/or the speed of the weft thread tip are preferably formed as a result of the measurement values which are determined for the current weft thread.

In a preferred embodiment, switch-off points are associated with the air nozzles, with the control system switching off one or more of the air nozzles which are charged with compressed air as soon as the predictor value for the position of the weft thread tip which is formed as a result of the measurement values reaches the switch-off point of the relevant air nozzle or air nozzles respectively.

Preferably, the switch-off point has a predetermined distance from the switch-on point of the corresponding air nozzle or air nozzles respectively and/or the switch-off point corresponds to position of a subsequent air nozzle in the shed.

In a further preferred embodiment the thread store is formed as a drum store onto which the weft thread can be wound up, with the measuring apparatus preferably being arranged at the thread store or in the vicinity of the thread store and including at least one sensor in order to be able to measure the drawing off of windings and/or of partial windings from the drum store.

Preferably at least one additional sensor is provided in the path of travel of the weft thread in order to be able to measure the position of the weft thread tip within the shed, and/or a weft thread monitor at the capture side end of the shed.

In a further preferred embodiment the control system additionally includes a regulation device which is connected to the sensors of the measuring apparatus and/or to the sensor in the path of travel of the weft thread and/or to the weft thread monitor in order to be able to determine, from the measurement values of the sensors and/or of the weft thread monitor, the time required for the insertion of the weft thread and to compare it with a predetermined insertion time in order to be able to regulate the pressure and/or the blowing time and/or the flow through the air nozzles using the difference between the time required for the insertion of the weft thread and the predetermined insertion time.

In the method in accordance with the present invention for the insertion of a weft thread into a shed of an air jet weaving machine using a system which includes a thread store, a measuring apparatus in order to be able to measure the weft thread which is drawn off from the thread store, a plurality of air nozzles for the insertion of the weft thread and a control system, the compressed air supply of the air nozzles is controlled in dependence on measurement values of the measuring apparatus, with switch-on points being associated with the air nozzles, with predictor values for the position of the weft thread tip being formed with the help of the measurement values, in particular with a safety value or factor being contained in the predictor values for the position of the weft thread tip, and with the control system charging one or more of the air nozzles with compressed air as soon as a predictor value for the position of the weft thread tip which is formed with the help of the measurement values reaches the switch-on point of the relevant air nozzle or air nozzles respectively.

In a preferred embodiment, the time required for the insertion of the weft thread is additionally determined and compared with a predetermined insertion time, and the difference between the time required for the insertion of the weft thread and the predetermined insertion time is used to regulate the pressure and/or the blowing time and/or the flow through the air nozzles.

The system in accordance with the present invention has an advantage in that it is substantially built up of system components which are currently present in most of the standard weaving machines. The only new system component required is an addition to the control program in which certain advantageous functions are implemented. In addition, the system and method in accordance with the present invention enables the compressed air consumption to be reduced substantially with respect to the older machines without having to tolerate losses in cloth quality, since the weft yarn is not loaded by the compressed air any more than is necessary. Forming a predictor value for the position of the weft thread tip, as a result of measurement values which can be determined outside the shed, enables corrections to be made during the momentary weft insertion and in so doing to dispense with sensors and weft thread monitors in the shed. The danger of the cloth quality being impaired by sensors and weft thread monitors which are arranged in the shed is thereby avoided.

The present invention will be explained in the following in more detail with reference to the exemplary embodiments and with reference to the drawings.

DESCRIPTION OF THE PREFERRED EMBODIMENTS

Figure 1:
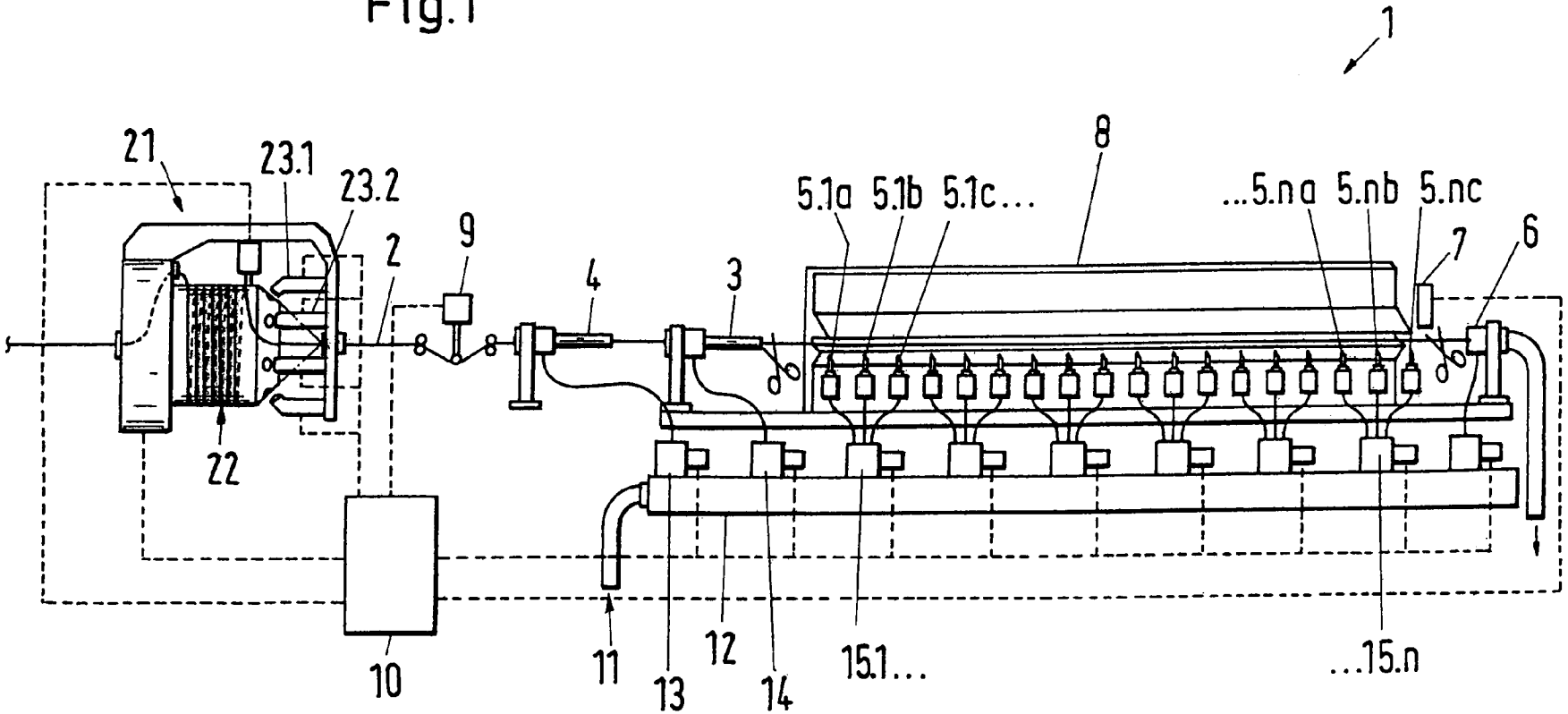
FIG. 1 illustrates an exemplary embodiment of an air jet weaving machine including a system for inserting a weft thread in accordance with the present invention.

FIG. 1 shows an exemplary embodiment of an air jet weaving machine 1 including a system in accordance with the present invention. The system for inserting a weft thread 2 into a shed (not illustrated in FIG. 1) includes a thread store 21 and a measuring apparatus 23.1, 23.2 in order to be able to measure the weft thread 2 which is drawn off from the thread store, and in particular in order to be able to measure the length and/or the speed of the drawn-off weft thread, said measuring apparatus preferably being arranged outside the shed, for example at the thread store 21 or in the vicinity of the thread store. Furthermore, the system includes a plurality of air nozzles 3, 4, 5.1*a–c* to 5.*na–c* for the insertion of a weft thread 2 and a control system 10 which is connected to the measuring apparatus 23.1, 23.2 in order to be able to control the compressed air supply of the air nozzles 3, 4, 5.1*a–c* to 5.*na–c* in dependence on measurement values of the measuring apparatus 23.1, 23.2. In a preferred embodiment the thread store 21 is formed as a drum store, which includes a drum 22 onto which the weft thread is wound up. In this embodiment the measuring apparatus is advantageously arranged in the vicinity of the drum store 21 and includes at least one sensor 23.1, 23.2 in order to be able to measure the drawing off of windings and/or partial windings from the drum store 22. The sensors 23.1, 23.2 will therefore be designated in the following as "winding counters". In one variant embodiment the drum store 22 has a circumference of 0.5 m and the measuring apparatus is typically provided with three or more sensors 23.1, 23.2 which are arranged about the drum at equal angular distances.

In the exemplary embodiment the air nozzles comprise a main nozzle 3, a tandem nozzle 4 and relay nozzles 5.1*a–c* to 5.*na–c* in order to be able to accelerate the weft thread 2 which is drawn off from the thread store 21 and to insert it into the shed by means of the main nozzle 3 and the tandem nozzle 4 and to be able to transport it further in the shed by means of the relay nozzles 5.1*a–c* to 5.*na–c*. A single main nozzle only can also be provided in place of the main and tandem nozzles 3, 4; or a plurality of main nozzles, frequently designated as pre-nozzles and main nozzles, can be arranged one after the other in order to be able to accelerate the weft thread. Naturally a large number of main nozzles 3 which lie alongside one another can also be provided in order to be able alternatingly to insert different weft threads 2 which can differ in color, fineness, texture and material. The relay nozzles 5.1*a–c* to 5.*na–c* are frequently combined into groups of two to five or more nozzles, with the nozzles of a group in each case being supplied in common with compressed air via a control valve 15.1 to 15.*n*, for example a magnetic valve. The control valves 15.1 to 15.*n* are expediently connected to a compressed air store and/or distributor 12 which is supplied via a pressure line 11 with compressed air. A plurality of compressed air stores and/or distributors 12 which have different pressure levels can also be provided.

In one variant the system for the insertion of a weft thread includes a thread brake 9 which is controlled by the control system 10. By means of the thread brake 9 the weft thread 2 can be braked, in particular towards the end of the weft insertion, when the weft thread tip approaches the weft arrival side of the shed. In addition, a weft thread monitor 7 can be provided at the weft arrival side of the shed in order to be able to detect the arrival of the inserted weft thread 2.

Furthermore, the air jet weaving machine 1 of the exemplary embodiment includes a reed 8 in order to be able to beat up the weft thread 2 and a severing device at each end of the shed in order to be able to sever the weft thread 2 after the beating up. A stretching or capture nozzle 6 is advantageously provided at the capture side end of the shed in order to be able to stretch the inserted weft thread 2 up to the reed beat up and/or to dispose of the end of the weft thread after the severing.

Figure 3:
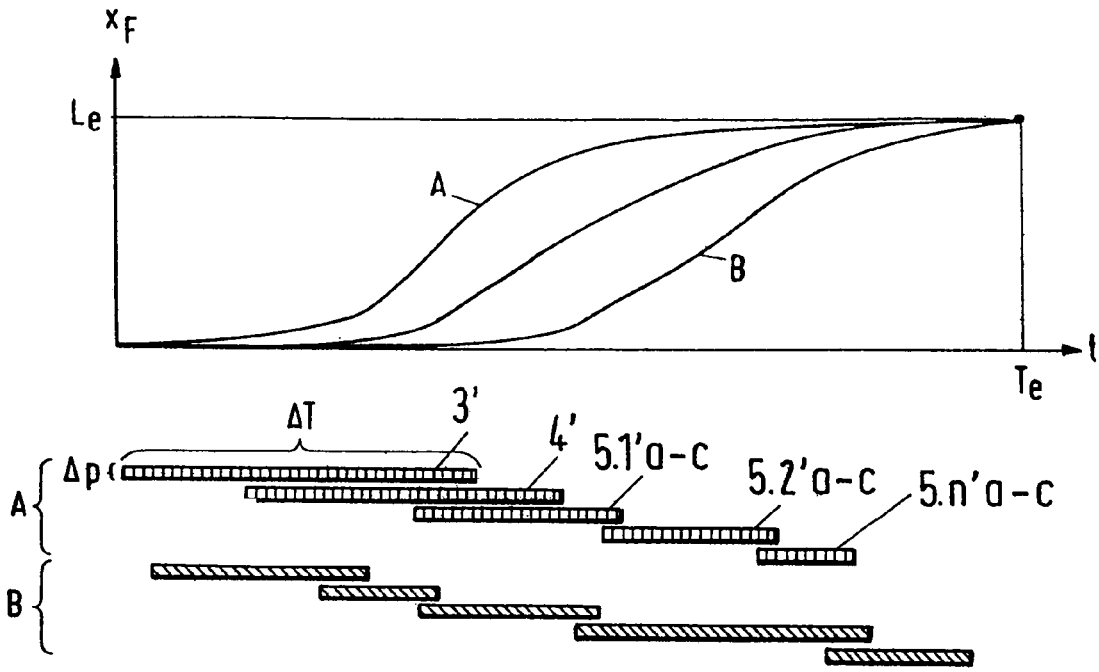
FIG. 3 illustrates two weft insertion profiles in a system in accordance with the present invention.

In the exemplary embodiment which is shown in FIG. 1 the control valves 13, 14, 15.1 to 15.*n* are controlled by the control system 10 in such a manner that the air nozzles 3, 4, 5.1*a–c* to 5.*na–c* are supplied with suitable amounts of air at the correct time point in order to be able to insert the weft thread 2 into the shed. FIG. 3 shows two different insertion profiles A and B. The first horizontal bar 3' represents the amount of air of the main nozzle 3, the second bar 4' the amount of air of the tandem nozzle 4, the third bar 5.1'*a.c* the amount of air of the relay nozzles 5.1*a–c*, etc. In this the thickness of the bar corresponds to the pressure Δp which is in each case present at the relevant nozzle, the length of the bar to the blowing time Δt and the position of the bar in the horizontal direction to the position of the switch-on and switch-off times in the temporal sequence of the weft insertion. As can be seen in the upper drawing of FIG. 3, the same insertion time $T_e$ is achieved with both insertion profiles. Nevertheless the compressed air consumption is different for the two insertion profiles A and B. In the case that all relay nozzles 5.1*a–c* to 5.*na–c* are formed the same and are charged with the same pressure $\Delta p_j$, the compressed air consumption of the relay nozzles 5.1*a–c* to 5.*na–c* is proportional to the sum $\Sigma\Delta T_j$ of the individual blowing times $\Delta T_j$.

Figure 4:
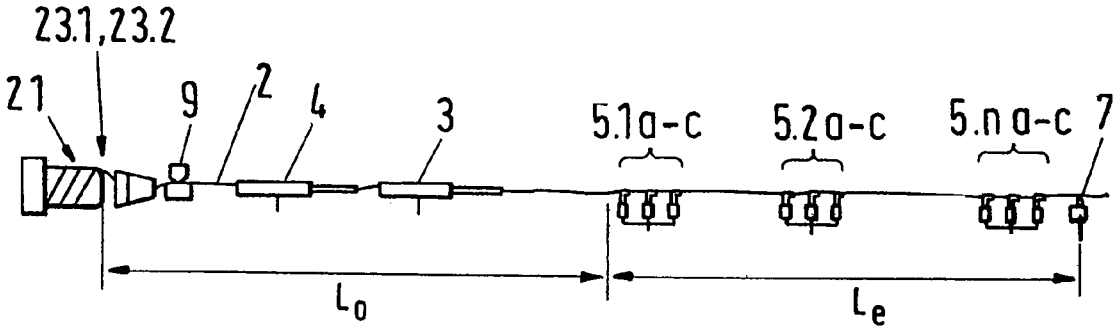
FIG. 4 illustrates an exemplary embodiment of a system in accordance with the present invention.

FIG. 4 shows an exemplary embodiment of a system for the insertion of a weft thread 2 in accordance with the present invention, with only those components being illustrated which are directly in contact with the weft thread and/or which accelerate, transport or brake and/or detect the latter. The individual components of this system have already been described in the context of the exemplary embodiment of FIG. 1. The length $L_o$ designates the length of the weft thread 2 between the thread store 21 and the shed, and the length $L_e$ the length of the weft thread to be inserted into the shed.

Figure 2A:
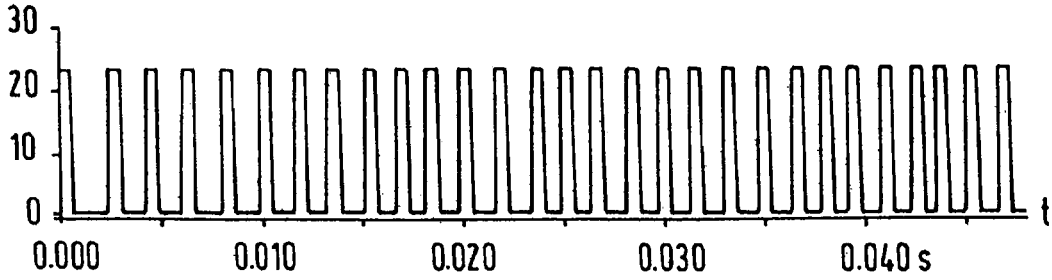
FIG. 2*a* illustrates the winding counter signal during the first half of the weft insertion in a system in accordance with the present invention.

FIG. 2*a* shows a typical plot of the winding counter signal during the first half of the weft insertion in a system in accordance with the variant embodiment to be described in the following. In this variant embodiment the thread store 21 includes a drum 22 with a circumference u of 0.50 m onto which the weft thread to be inserted is wound up. The measuring apparatus includes six light sensors 23.1, 23.2, which are arranged in the shape of a ring at the outlet of the drum store 21 and which detect the passing weft thread; i.e. six pulses are generated per drawn-off winding. From this there results for the determination of the drawn-off weft thread length L or the position $x_f$ of the weft thread tip respectively a resolution $e_x$ of $$e_x = \frac{U}{6} = \frac{0.50\text{ m}}{6} = 0.083\text{ m} \tag{1}$$

The time interval $\Delta t_j$ between two rising flanks of the winding counter signal is proportional to the inverse of the average speed of the thread tip $v_F$ in this time interval, i.e.

$$v_F(t_j)=e_x\cdot\Delta t_j^{-1} \tag{2}$$

Figure 2B:
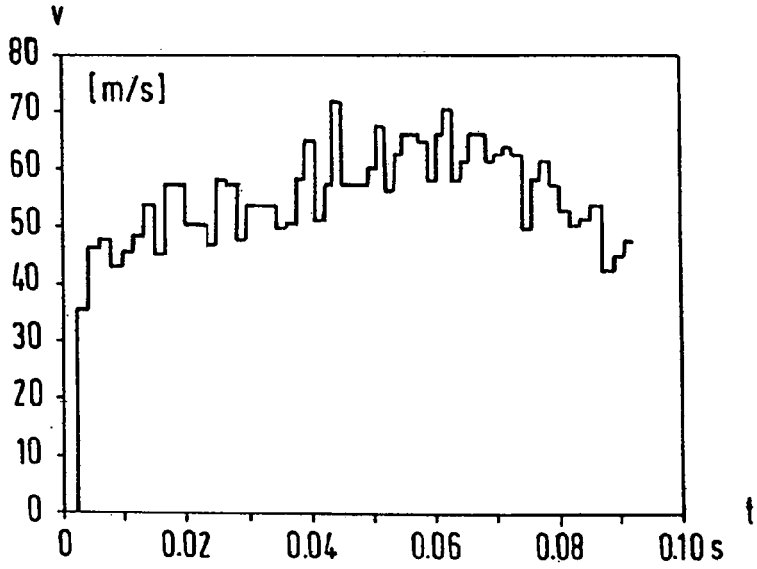
FIG. 2*b* illustrates the speed of the weft thread tip as calculated from the winding counter signal.

A typical plot of the speed $v_F$ during the weft insertion is illustrated in FIG. 2*b*.

During the weft insertion the winding counter signal supplies discrete pulses at certain time intervals, as shown in FIG. 2*a*, by means of which the momentary position of the weft thread tip can be determined. In certain cases the winding counter signal can be filtered prior to the evaluation. In order to determine the position of the weft thread tip continuously, the position of the weft thread tip which is determined from the winding counter signal is extrapolated up to the arrival of the next pulse in the exemplary embodiment, for example by means of the following formula (3). The thus determined position ($x_F$) of the weft thread tip will be designated in the following as the "predictor value for the position of the weft thread tip".

$$x_F(t_{k+1})=x_F(t_k)+v_F(t_k)\cdot T_{Zyklus} \tag{3}$$

with $v_F(t_k)$=the speed of the thread tip $T_{Zyklus}$=the cycle time of the control system, and k=the index of the control cycle.

Figure 2C:
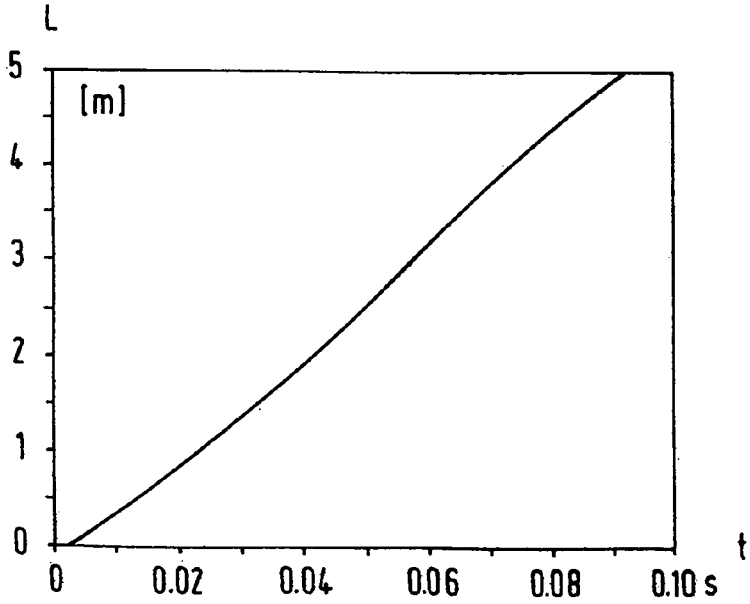
FIG. 2*c* illustrates predictor values for the position of the weft thread tip which were calculated as a result of the winding counter signal.

A typical plot of the predictor value $x_F$ for the position of the weft thread tip is illustrated in FIG. 2*c*.

Figure 5:
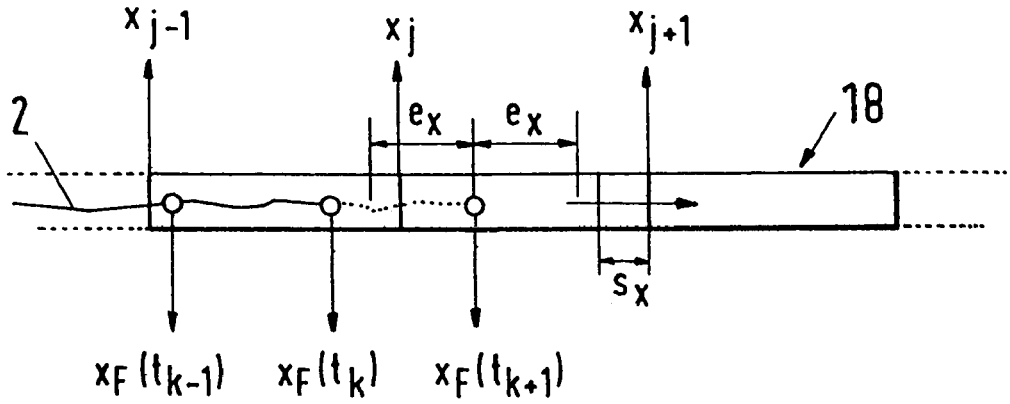
FIG. 5 is a detail view of the weft thread tip pertaining to the exemplary embodiment which is shown in FIG. 4.

The forming of the named predictor value $x_F$ for the position of the weft thread will be explained in detail in the following, since a central role is played by this predictor value in the system and method in accordance with the invention. FIG. 5 shows a detail view of the weft thread tip pertaining to the exemplary embodiment which is shown in FIG. 4. At the time $t_k$ the end of a weft thread 2 is located at the position $x_F(t_k)$ within the shed. The weft thread 2 is further transported in a weft passage 18, which is formed in the reed 8 (see FIG. 1), by means of the air nozzles 3, 4, 5.1*a–c* to 5.*na–c* (not shown in FIG. 5). In the present exemplary embodiment the movement of the weft thread proceeds from left to right in accordance with weft insertion direction. Starting from the momentary position $x_F(t_k)$, a predictor value $x_F(t_{k+1})$ for the position of the weft thread tip is formed, for example by means of the formula (3). The initial position $x_F(t_k)$ can be a position which was, e.g., detected by a sensor which is arranged in the shed or which was directly derived from a new pulse of the winding counter or, if at time $t_k$ no pulse of this kind had arrived, the previous predictor value.

The predictor value for the position of the weft thread tip advantageously contains a safety factor, which depends in particular on the resolution $e_x$ of the measuring apparatus and/or on the switch-on time $T_{Vent}$ for the pressure build-up in the region of the relevant air nozzle and/or on the speed $v_F(t_k)$ of the weft thread tip. In this the distance $s_x$ which is traveled during the switch-on time $T_{Vent}$ depends on the speed $v_F(t_k)$ of the weft thread tip:

$$s_x(t_{k+1})=v_F(t_k)\cdot T_{Vent} \tag{4}$$

A predictor value $x_F(t_{k+1})$ for the position of the weft thread tip which contains a corresponding safety factor can for example be calculated according to the following formula:

$$\begin{aligned} x_F(t_{k+1}) &= x_F(t_k) + v_F(t_k)\cdot T_{Zyklus} + s_x + e_x \\ &= x_F(t_k) + v_F(t_k)\cdot(T_{Zyklus} + T_{Vent}) + e_x \end{aligned} \tag{5}$$

In the exemplary embodiment which is shown in FIG. 4, switch-on points $x_j$, which are specially marked in FIG. 5, are associated with the air nozzles 3, 4, 5.1*a–c* to 5.*na–c*, with the control system 10 charging one or more of the air nozzles 3, 4, 5.1*a–c* to 5.*na–c* with compressed air as soon as a predictor value $x_F(t_{k+1})$ for the position of the weft thread tip which is formed with the help of the measurement values, for example of the winding counter signal, reaches the switch-on point $x_j$ of the relevant air nozzle or air nozzles respectively. I.e. an air nozzle j or group of air nozzles is switched on if $$x_F(t_{k+1}) \geqq x_j \tag{6}$$

The switch-on point $x_j$ of an air nozzle advantageously corresponds to the position of the air nozzle in the shed, or, respectively, in the case of a group of air nozzles which are charged with compressed air at the same time, to the position of the first air nozzle of the group. The above-mentioned safety value or parts of the latter can also be taken into account in the determination of the switch-on point $x_j$ instead of during the forming of the predictor value $x_F(t_{k+1})$.

In a preferred embodiment, switch-off points are associated with the air nozzles 3, 4, 5.1*a–c* to 5.*na–c*, with the control system 10 switching off one or more of the air nozzles which are charged with compressed air as soon as a predictor value $x_F(t_{k+1})$ for the position of the weft thread tip which is formed as a result of the measurement values reaches the switch-off point of the relevant air nozzle or air nozzles respectively. The switch-off point preferably has a predetermined distance from the switch-on point of the corresponding air nozzle or air nozzles respectively, and/or the switch-off point preferably corresponds to the position of a following air nozzle in the shed. In particular it can be expedient to couple the switch-off points of the main and/or tandem nozzles 3, 4 to the switch-off point of a relay nozzle 5.1*a–c* to 5.*na–c*, for example in that the main and/or tandem nozzles are switched off at the same time as the relevant relay nozzle.

In particular for larger weaving widths it is advantageous to provide at least one additional sensor in the path of travel of the weft thread 2 in order to be able to measure the position of the weft thread tip.

In a further preferred embodiment the control system 10 additionally includes a regulation device which is connected to the sensors 23.1, 23.2 of the measuring apparatus and/or to the sensor in the path of travel of the weft thread 2 and/or to the weft thread monitor 7 in order to be able to determine from the measurement values of the sensors and/or of the weft thread monitor the time $T_e$ required for the insertion of the weft thread 2 and to compare it with a predetermined desired insertion time, and in order to be able to regulate the pressure and/or the blowing time and/or the flow through the air nozzles 3, 4, 5.1*a–c* to 5.*na–c* using the difference between the time required for the insertion of the weft thread and the predetermined desired insertion time. A corresponding regulation device, which is known under the designation "time controller", is described for example in U.S. Pat. No. 4,446,893. In this, the regulation can be designed in such a manner that the difference between the time required for the insertion of the weft thread and the predetermined desired insertion time becomes a minimum or lies within predetermined values. In a preferred further development the time $T_e$ which is required for the insertion of the weft thread 2 is measured over a number of successive weft insertions and an average insertion time is determined from this. The thus determined average insertion time can be used as the desired insertion time for a new article. Furthermore, it is also possible to regulate the pressure and/or the blowing time and/or the flow through the air nozzles 3, 4, 5.1*a–c* to 5.*na–c* using the difference between an average insertion time and a predetermined desired insertion time.

Figure 6:
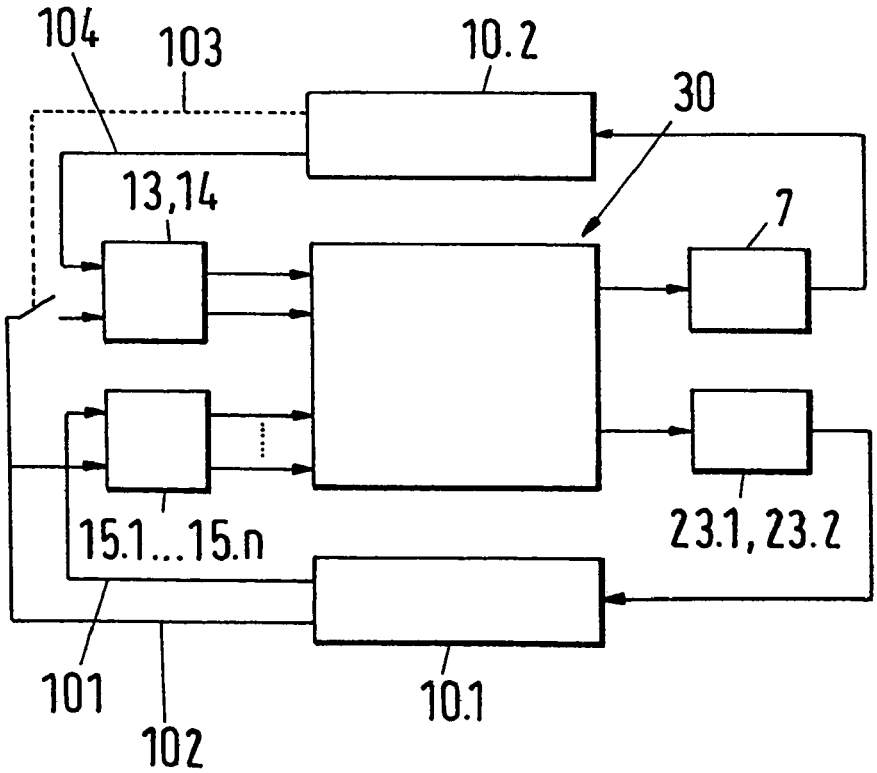
FIG. 6 is a block diagram of a variant of the regulation and control loops pertaining to the exemplary embodiment which is shown in FIG. 4.

FIG. 6 shows a block diagram of a variant embodiment of the regulation and control circuits pertaining to the exemplary embodiment which is shown in FIG. 4. The components of the system for the insertion of a weft thread which are shown in FIG. 4 are summarized under the reference numeral 30. The length of the drawn-off weft thread is measured by means of the sensors 23.1, 23.2, which are illustrated separately in FIG. 6, and the output signal of these sensors is conducted to a control system 10.1. From the output signal the control system 10.1 forms predictor values for the position of the weft thread tip and controls the switching on and off of the relay nozzles in the manner which was described above. The signal path 101 conducts the switch-on signals for the relay nozzles to the corresponding control valves 15.1 to 15.*n*. A further signal path 102 conducts switch-off signals for the relay nozzles to the corresponding control valves. In certain cases the control apparatus can also generate switch-off signals for the main and tandem nozzles in order to be able to control the switching off of the corresponding compressed air supply 13, 14. A weft thread monitor 7, which is separately illustrated in FIG. 6, detects the arrival of the weft thread tip at the weft arrival side of the shed. The signal of the weft thread monitor 7 is conducted to a regulation device 10.2, which, as described above, determines from the signal of the weft thread monitor the time required for the insertion of the weft thread and compares it with a predetermined desired insertion time, and which regulates the pressure and/or blowing time, and/or the switching off of the air nozzles respectively using the difference between the time required for the insertion of the weft thread and the predetermined desired insertion time. The signal path 104 conducts the control signal for the pressure to the compressed air supply 13, 14 of the main and tandem nozzles. In certain cases the compressed air supply 13, 14 includes settable and/or controllable pressure regulators, mass flow controllers and/or control valves. Yet a further signal path 103 can be provided between the regulation device 10.2 and the compressed air supply 13, 14 of the main and tandem nozzles, via which the switching off of the main and tandem nozzles can be controlled.

In an advantageous variant embodiment the pressure of the main and tandem nozzles is set manually and the switching off of the main and tandem nozzles is regulated by means of the regulation device 10.2 in dependence on the time which is required for the insertion of the weft thread. In contrast to this, the switching on of the main and tandem nozzles takes place at a predetermined time point, which for example can be coupled to the main shaft of the machine.

In a further advantageous variant embodiment the pressure of the main and tandem nozzles is regulated by means of the regulation device 10.2 in dependence on the time which is required for the insertion of the weft thread. The main and tandem nozzles are switched on at a predetermined time point, which for example can be coupled to the main shaft of the machine, and switched off by means of the control system 10.1 in dependence on a predictor value for the position of the weft thread tip. It can be expedient in particular in this variant embodiment to couple the switch-off time points of the main and/or tandem nozzles to the switch-off time point of a relay nozzle, for example in that the main and/or tandem nozzles are switched off at the same time as the relevant relay nozzle.

Further advantageous variant embodiments result in that the pressure and/or the switch-off time point of the relay nozzles is or are regulated by means of the regulation device 10.2 in dependence on the time required for the insertion of the weft thread. In place of the pressure the flow through the corresponding air nozzles can also be regulated in all previously mentioned variant embodiments.

The above listing of variant embodiments is by no means exhaustive. Further variant embodiments can be derived through modification of the circuit diagram which is shown in FIG. 6, all of which have the advantages of the system and method in accordance with the invention and all of which in particular enable an economical operation of the air jet weaving machine in that the compressed air consumption can be substantially reduced in comparison with older machines.

The invention claimed is:

1. A method for the insertion of a weft thread into a shed of an air jet weaving machine, wherein the weft thread is drawn off from a thread store, the drawn off weft thread being measured with the help of a measuring apparatus, wherein the weft thread is inserted into the shed by means of a plurality of air nozzles and a control system controlling the compressed air supply of the air nozzles in dependence on measurement values of the measuring apparatus, wherein switch on points are associated with the air nozzles;

wherein predictor values for the position of the weft thread tip are formed with the help of the measurement values;

wherein a safety value or factor is contained in the predictor values for the position of the weft thread tip;

and wherein the control system charges one or more of the air nozzles with compressed air as soon as a predictor value for the position of the weft thread tip, which is formed with the help of the measurement values, reaches the switch on point of the relevant air nozzle or air nozzles, respectively.

2. A method in accordance with claim 1, wherein the time which is required for the insertion of the weft thread additionally is determined and compared with a predetermined desired insertion time, and wherein the difference between the time required for the insertion of the weft thread and the desired insertion time is used in order to regulate at least one of the pressure, the blowing time and the flow through the air nozzles.

3. A system for inserting a weft thread into a shed of an air jet weaving machine, said system including a thread store, a measuring apparatus in order to be able to measure the weft thread which is drawn off from the thread store, a plurality of air nozzles for the insertion of the weft thread and a control system which is connected to the measuring apparatus in order to be able to control the compressed air supply of the air nozzles in dependence on measurement values of the measuring apparatus;

wherein switch on points are associated with the air nozzles;

wherein predictor values for the position of the weft thread tip are formed with the help of the measurement values;

wherein a safety value or factor is contained in the predictor values for the position of the weft thread tip; and wherein the control system charges one or more of the air nozzles with compressed air as soon as a predictor value for the position of the weft thread tip, which is formed with the help of the measurement values, reaches the switch on point of the relevant air nozzle or air nozzles, respectively.

4. A system in accordance with claim 3, wherein the air nozzles include at least one of at least one main nozzle and at least one tandem nozzle, and more than one relay nozzle, and wherein switch-on points are associated with the relay nozzles, and wherein the control system charges more than one of the relay nozzles with compressed air as soon as a predictor value for the position of the weft thread tip which is formed with the help of the measurement values reaches the switch-on point of the relevant relay nozzles.

5. A system in accordance with claim 3, wherein the switch-on point of a group of air nozzles which are charged with compressed air at the same time corresponds to the position of the first air nozzle of the group.

6. A system in accordance with claim 3, wherein the predictor value for the position of the weft thread tip contains a safety value or factor which depends on at least one of the resolution of the measuring apparatus, the switch-on time for the pressure build up in the region of the relevant air nozzle and the speed of the weft thread tip.

7. A system in accordance with claim 3, wherein the predictor value for at least one of the position of the weft thread tip and the speed of the weft thread tip are formed as a result of the measurement values which are determined for the current weft thread.

8. A system in accordance with claim 3, wherein switch off points are associated with the air nozzles, wherein the control system switches off one or more of the air nozzles which are charged with compressed air as soon as the predictor value for the position of the weft thread tip which is formed as a result of the measurement values reaches the switch off point of the relevant air nozzle or air nozzles respectively, wherein the switch off point has a predetermined distance from the switch on point of the relevant air nozzle or air nozzles respectively, and wherein the switch off point corresponds to the position of a subsequent air nozzle in the shed.

9. A system in accordance with claim 3, wherein the air nozzles include at least one main nozzle, and at least one tandem nozzle, and one or more relay nozzles, and wherein it is possible to couple the switch off points of the main nozzle and/or tandem nozzle to the switch off point of a predetermined relay nozzle.

10. A system in accordance with claim 3, wherein the thread store is formed as a drum store onto which the weft thread can be wound, and wherein the measuring apparatus is arranged at the thread store and includes at least one sensor in order to be able to measure the draw off of at least one of windings and partial windings from the drum store.

11. A system in accordance with claim 3, wherein the system additionally includes a thread brake in order to be able to brake the weft thread towards the end of the weft insertion when the weft thread tip approaches the weft thread arrival side of the shed.

12. A system in accordance with claim 3, wherein at least one of at least one additional sensor is provided in the path of travel of the weft thread in order to be able to measure the position of the weft thread tip and a weft thread monitor is provided on the weft thread arrival side of the shed.

13. A system in accordance with claim 12, wherein the control system additionally includes a regulation device which is connected to at least one of the sensors, the sensor in the path of travel of the weft thread and the weft thread monitor in order to be able to determine, from the measurement values of at least one of the sensors and the weft thread monitor, the time required for the insertion of the weft thread and to be able to compare it with a predetermined desired insertion time, and in order to be able to regulate at least one of the pressure, the blowing time and the flow through the air nozzles using the difference between the time required for the insertion of the weft thread and the desired insertion time.

* * * * *